US006949061B2

(12) United States Patent
Penn

(10) Patent No.: US 6,949,061 B2
(45) Date of Patent: Sep. 27, 2005

(54) APPARATUS FOR WORKING WITH SHEET MATERIAL

(76) Inventor: Boyce Penn, Box 573 Lemay Trail, Jacksonville, AR (US) 72076

( * ) Notice: Subject to any disclaimer, the term of this patent is extended or adjusted under 35 U.S.C. 154(b) by 374 days.

(21) Appl. No.: 10/040,125

(22) Filed: Dec. 31, 2001

(65) Prior Publication Data

US 2003/0125178 A1 Jul. 3, 2003

(51) Int. Cl.[7] ..... B31B 49/00
(52) U.S. Cl. ..... 493/475; 83/425.4
(58) Field of Search ..... 83/607, 916, 425.4, 83/508.3, 599, 608; 493/475, 478, 479

(56) References Cited

U.S. PATENT DOCUMENTS

| | | | | |
|---|---|---|---|---|
| 1,272,068 A | | 7/1918 | McClure et al. | |
| 2,023,638 A | | 12/1935 | Lawson | |
| 3,468,206 A | | 9/1969 | Bakula | |
| 3,564,893 A | | 2/1971 | Richards et al. | |
| 4,960,023 A | * | 10/1990 | Reuter et al. | 83/368 |
| 5,412,971 A | | 5/1995 | Axelsson | |
| 5,582,053 A | | 12/1996 | Chubb et al. | |
| 5,664,451 A | * | 9/1997 | Schultz | 72/181 |
| 5,709,122 A | | 1/1998 | Hammar | |
| 5,732,585 A | | 3/1998 | Haushahn et al. | |
| 5,775,193 A | * | 7/1998 | Pratt | 83/659 |
| 5,819,577 A | | 10/1998 | D'Arcy | |
| 5,860,214 A | | 1/1999 | Morikawa et al. | |
| 5,950,375 A | | 9/1999 | Zaccagni | |
| 6,233,995 B1 | | 5/2001 | Cleave et al. | |

* cited by examiner

*Primary Examiner*—John Paradiso
(74) *Attorney, Agent, or Firm*—Mark Murphey Henry; Nathan Price Chaney

(57) ABSTRACT

An apparatus and method of using the same is disclosed. The apparatus has a base and a plurality of shears adjustably secured thereto. Each shear has one cutting element that is adjustable secured to the base and another cutting element that is pivotally secured to the other cutting element. A handle operably connects the cutting elements to allow simultaneous cutting by the shears. The cutting apparatus is useful in bending sheet material such as aluminum or vinyl coil stock used in trimming structures. In use, the shears are adjusted on the base to cut slits in desired locations on a sheet. A sheet is put in place, and the shears are actuated to cut a plurality of slits in a side of sheet material, preferably simultaneously. The sheet is then repositioned, and the shears are actuated to cut a plurality of slits in another side of the sheet. The sheet is then folded along lines extending between pairs of slits. The folded sheet is then affixed to a structure such as a house. The apparatus and method are particularly useful for site-forming trim from coil stock for use in areas such as fascia and soffits.

8 Claims, 5 Drawing Sheets

APPARATUS FOR WORKING WITH SHEET MATERIAL

BACKGROUND OF THE INVENTION

This invention relates to customized sheet work, and more particularly to an apparatus and method for site-forming sheet material, such as aluminum or vinyl coil stock.

Siding material, such as aluminum or vinyl siding, is well known and can provide a low cost, low maintenance exterior to a home or structure. Whether in a new installation or in a re-siding job working, around trim such as fascia and soffits presents a number of challenges. It is often desirable to use sheet material such as coil stock, including aluminum coil stock, vinyl coil stock and the like, in areas such as the fascia and soffits. It is often desirable to site-form siding components for a variety of trim or eaves conditions. In such a situation, an installer will typically measure the relevant portions of a structure to determine where bends should be formed in the sheet material. The installer will then measure and mark opposite ends of the sheet material and will use shears, tin snips, or the like to individually cut slits at opposite sides of the sheet material. The slits are cut because it is typically easier to form a crisp, straight bend in sheet material if slits are cut in opposite sides of the sheet material, along a line at which the sheet will be bent. After the slits are cut, the installer will typically use a brake or bending tool to form the bends in the sheet material.

The ability to site-form custom pieces offers a number of advantages. For example, it offers greater flexibility and a better fit and avoids delays and added costs when working with trim having non-standard dimensions. It may also reduce material transportation cost since it is typically easier to transport a roll of coil stock than it is to transport long pieces of pre-formed parts. It also makes it easier to provide joint free pieces covering longer spans. Still, site-forming of sheet material is not without problems. For example, it can be time-consuming to individually measure and mark places to be cut along multiple sides of sheet material. Similarly, it can be time-consuming to individually cut a number of slits in multiple sides of sheet material. Further still, it can be difficult to properly align and accurately cut multiple, uniform slits with the precision desired for forming straight, crisp bends or folds.

SUMMARY OF THE INVENTION

It is therefore an object of the present invention to provide an apparatus that quickly, easily, and accurately cuts a plurality of slits in sheet material, along with a method of using the same.

It is a still further object of the present invention to provide such an apparatus that may be quickly and easily adjusted to cut multiple slits in sheet material having a variety of spacings and patterns, along with a method of using the same.

It is a further object of the present invention to provide an apparatus and method of using the same for cutting a number of slits in a side of sheet material simultaneously.

It is a still further object of the present invention to provide an apparatus and method of using the same that quickly, easily, and repeatedly provides consistent, uniform, accurate, and precise slits.

It is a still further object of the present invention to provide an apparatus and method of using the same that provides for consistent displacement of corresponding portions of corresponding slits in opposite sides of sheet material.

It is a still further object of the present invention to provide an apparatus and method of using the same that allows a cutting element to be rotated clockwise or counterclockwise as desired to provide the cutting action.

It is a still further object of the present invention to provide an apparatus useful in bending sheet material and a method of using the same that provides for simultaneously cutting a plurality of slits along one side of a sheet, then simultaneously cutting a plurality of slits along another side of the sheet.

It is a still further object of the present invention to provide an apparatus useful in trimming with coil stock and a method of using the same that provides for simultaneously cutting a plurality of slits along one side of a sheet, then simultaneously cutting a plurality of slits along another side of the sheet.

It is a still further object of the present invention to provide an apparatus useful in customized sheet preparation and a method of using the same that provides for using a plurality of shears that are adjustable along a length of a base.

Toward the fulfillment of these and other objects and advantages, an apparatus and method of using the same are disclosed. The apparatus has a base and a plurality of shears adjustably secured thereto. Each shear has one cutting element that is adjustably secured to the base and another cutting element that is pivotally secured to the other cutting element. A handle operably connects the cutting elements to allow simultaneous cutting by the shears. The cutting apparatus is useful in bending sheet material such as aluminum or vinyl coil stock used in trimming structures. In use, the shears are adjusted on the base to cut slits in desired locations on a sheet. A sheet is put in place, and the shears are actuated to cut a plurality of slits in a side of sheet material preferably simultaneously. The sheet is then repositioned, and the shears are actuated to cut a plurality of slits in another side of the sheet. The sheet is then folded along lines extending between pairs of slits. The folded sheet is then affixed to a structure such as a house. The apparatus and method are particularly useful for site-forming trim from coil stock for use in areas such as fascia and soffits.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figure 1:
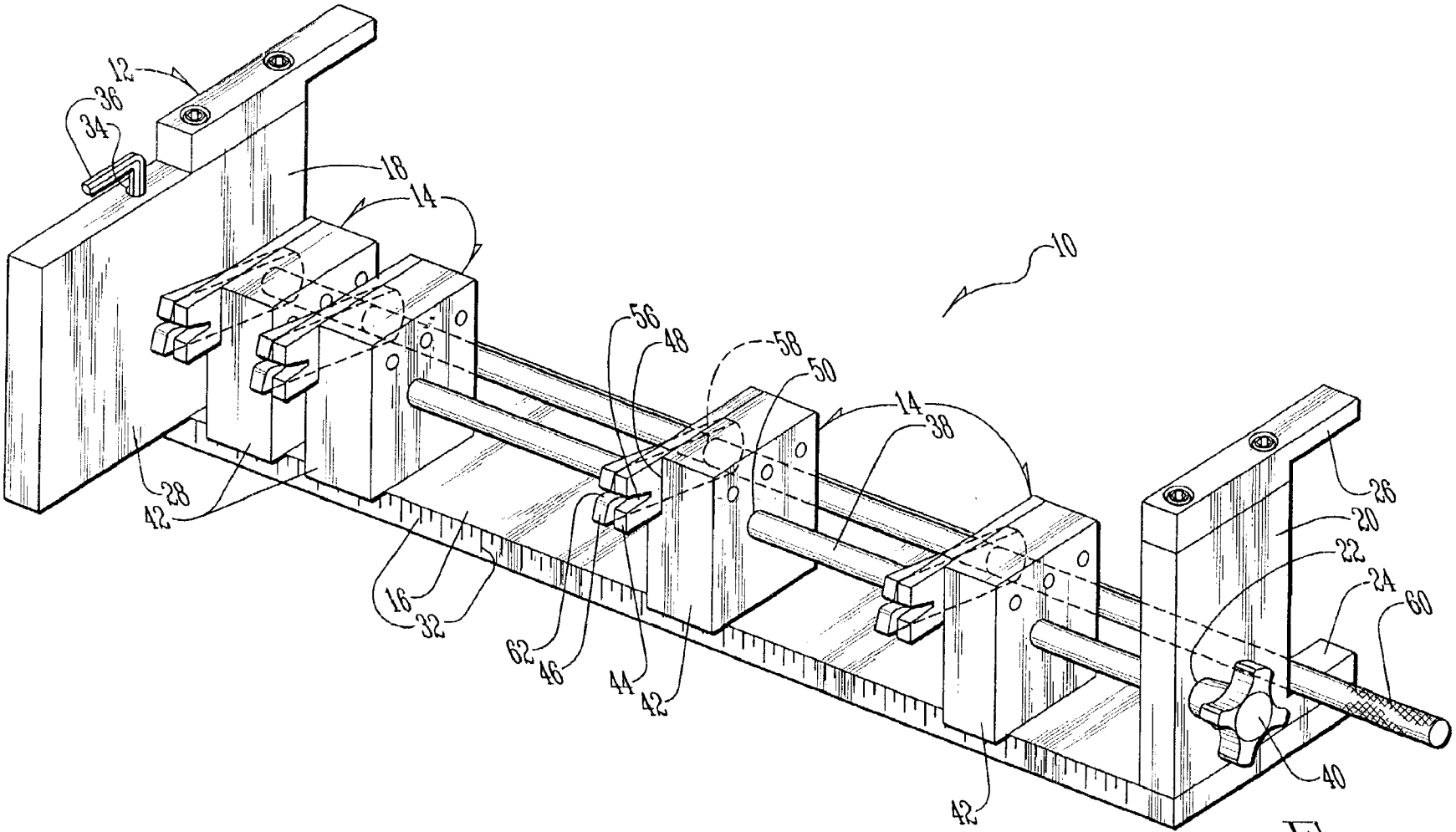
FIG. 1 is a front elevation view of a cutting apparatus for use in the present invention.

Referring to FIG. 1, the reference numeral 10 refers in general to a cutting apparatus of the present invention. The apparatus 10 comprises a base 12 and a plurality of shears 14 adjustably secured thereto.

The base 12 has a long, substantially planar lower member 16, and end members 18 and 20 extending upward therefrom. The base 12 may be made from any number of different materials or different combinations thereof, but it is preferably made from a strong lightweight metal, such as aluminum. In the preferred embodiment, the lower member 16 is formed from an aluminum plate and is ¾" thick, 16" long, and 4" wide. The end members 18 and 20 are also formed from aluminum plates that are ¾" thick and 4" tall. At one end of the lower member 16, the end member 18 is aligned with a front face of the lower member 16 and extends 2¾" rearward over most of its height. A hole 22 passes through the width of the end member 18 at a low, front portion thereof. A lower limit member 24 is formed integrally with the end member 18 and extends 1¼" rearward thereof so that a rear face of the lower limit member 24 is aligned with a rear face of the lower member 16. The lower limit member 24 extends ¾" above the lower member 16. An upper limit member 26 is affixed to the top of the end member. The upper limit member 26 is ¾" thick, ¾" wide, and 4" long. A notch is formed in a lower, rear portion of the upper limit member 26 so that a rear portion of the upper limit member 26 is ½" thick, ¾" wide, and 1¼" long. The rear face of the upper limit member 26 is aligned with the rear face of the lower member 16. The lower member 16, end member 18, and upper limit member 26 are rigidly affixed to one another, such as using screws.

At the other end of the lower member 16, end member 20 is provided. The end member 20 extends 3" forward from the front face of the lower member 16 and extends 2¾" rearward over most of its height. The portion 28 extending forward of the front face of the lower member 16 is used as a stop to assist in aligning sheet material 30. The front face of the lower member 16, the elongate member, or portions of the base 12 in close proximity thereto may be provided with markings or other indicia 32 showing measurements in units such as inches or centimeters. The markings 32 are preferably aligned to begin at and measure distance from the inner face of the stop portion 28 of end member 20. A hole 22 passes through the width of the end member 20 above and rearward of the front face of the lower member 16. A lower limit member 24 is formed integrally with the end member 20 and extends 1¼" rearward thereof so that a rear face of the lower limit member 24 is aligned with a rear face of the lower member 16. The lower limit member 24 extends ¾" above the lower member 16. An upper limit member 26 is affixed to the top of the end member 20. A hole 34 may be provided in an upper surface of the end member 20 to receive a tool 36 such as a hex wrench that may be useful in making adjustments in the apparatus 10. The upper limit member 26 is ¾" thick, ¾" wide, and 4" long. A notch is formed in a lower, rear portion of the upper limit member 26 so that a rear portion of the upper limit member 26 is ½" thick, ¾" wide, and 1¼" long. The rear face of the upper limit member 26 is aligned with the rear face of the lower member 16. The lower member 16, end member 20, and upper limit member 26 are rigidly affixed to one another, such as using screws. It is understood that the upper and lower limit members 26 and 24 may take any number of different shapes, sizes, and configurations. It is also understood that the upper and lower limit members 26 and 24 may be adjustable to control the length of slits to be cut.

An elongate member 38, such as an aluminum rod having a ½" diameter, is secured between the end members 18 and 20 and extends lengthwise along the base 12 above and rearward of the front face of the lower member 16, extending substantially parallel with the front face of the lower member 16. The elongate member 38 passes through holes 22 and is held in place between the end members 18 and 20 by fasteners 40 such as nuts, bolts, screws, or the like. It is preferred that the elongate member 38 be easily removable to facilitate adding or removing additional shears 14 depending upon the number of slits desired. It is of course understood that the elongate member 38 may take any number of shapes, sizes, and lengths. For example, the elongate member 38 may have a square or rectangular cross-section. It is also understood that the elongate member 38 may be secured to the base 12 in any number of ways or formed integrally therewith. It is of course understood that the base 12 may be formed from any number of different materials and that any or all of the components of the base 12 may be formed integrally or in any number of different combinations. It is also understood that the base 12 may take any number of different sizes, shapes, and configurations.

Each shear 14 is preferably substantially identical, so only one shear will be described in detail. The shear 14 has a mounting block 42, a first cutting element 44 rigidly secured to the mounting block 42, and a second cutting element 46 pivotally secured to the first cutting element 44. The mounting block 42 is preferably aluminum that is 1" wide, 3" tall, and 2" long. A notch 48 is formed in an upper portion of the block 42. The notch is ¼" wide and 1" tall and extends over the entire length of the block 42. A hole 50 passes through the width of the block 42 at a lower, central portion thereof. The elongate member 38 passes through the hole 50, and the block 42 rests on the upper surface of the lower member 16. The front face of the block 42 extends ½" forward of the front face of the lower member 16, and the length of the block 42 extends substantially perpendicular to the elongate member 38 and to the front face of the lower member 16. Another hole 52 passes from the rear face of the block 42, lengthwise through block 42 to the hole 50. This hole 52 is preferably threaded, and a threaded member 54, such as a bolt or other form of set screw is in threaded engagement therewith. Additional, holes may be provided through the width of the block 42 in an upper portion thereof for securing the first cutting element 44 to the block 42.

The cutting elements 44 and 46 are preferably made from a metal such as steel. It is preferred that the cutting elements 44 and 46 be made from a metal other than aluminum to provide for greater stiffness or hardness. The first cutting element 44 is ¼" thick, 1" tall, and 3" long. The rear face of the first cutting element 44 is aligned with the rear face of the block 42, and the front face of the first cutting element 44 extends 1" forward from the front face of the block 42 and 1.5" forward from the front face of the lower member 16. The length of the first cutting element 44 extends substantially perpendicular to the length of the elongate member 38 and to the front face of the lower member 16, and the front face of the first cutting element 44 extends substantially parallel to the front face of the block 42 and to the front face of the lower member 16. Holes are provided in a rear portion of the first cutting element 44 for rigidly affixing the first cutting element 44 to the block 42. A hole is provided forward of the front face of the block 42 for pivotal attachment of the second cutting element 46. A generally V-shaped notch 56 is formed in the front face of the first cutting element 44. The notch 56 is ⅜" tall at the front face of the first cutting element 44 and extends ⅜" rearward along the length and across the entire width. The upper and lower faces of the notch 56 are substantially flat or planar.

Figure 3:
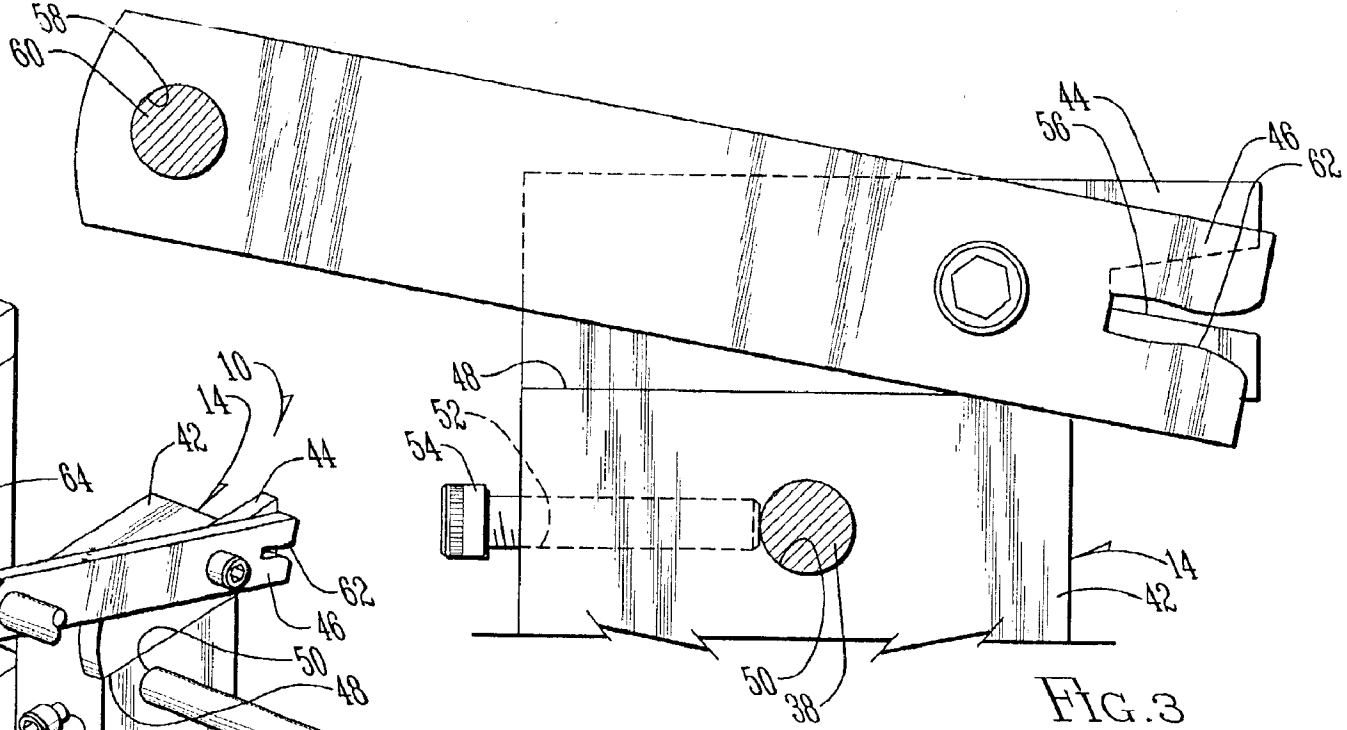
FIG. 3 is an enlarged side view of a pair of cutting elements.
Figure 2:
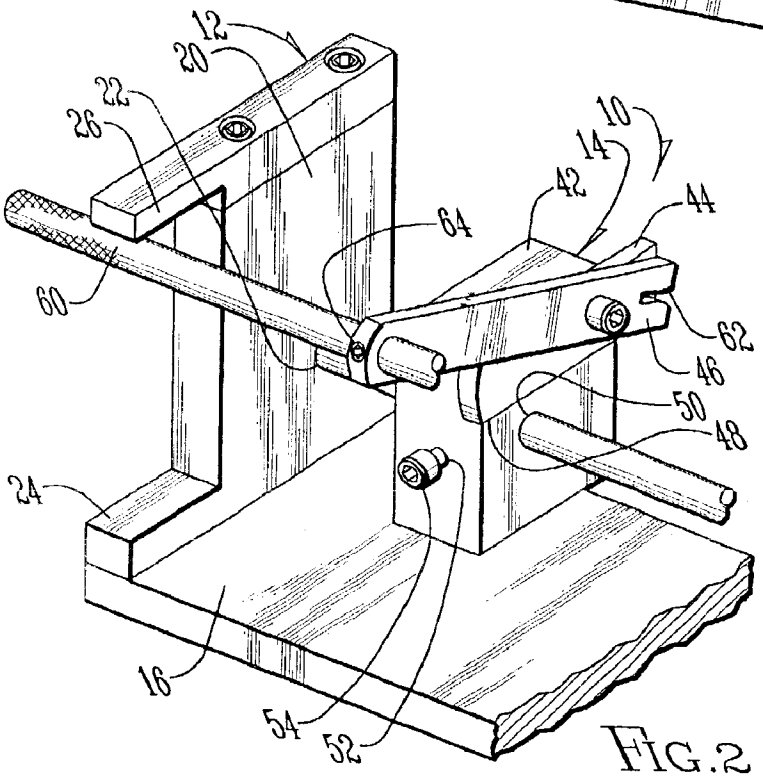
FIG. 2 is a partial, rear view of a cutting apparatus for use in the present invention.

The second cutting element 46 is ¼" thick, 1" tall, and 5½" long. When the second cutting element 46 is in a neutral position the front face of the second cutting element 46 is aligned with the front face of the first cutting element 44, the top face of the second cutting element 46 is aligned with the top face of the first cutting element 44, and the rear face of the second cutting element 46 is aligned with the rear face of the lower member 16. A hole 58 passes through the width of a distal portion of the second cutting element 46 for receiving a handle 60. Another hole is provided forward of the front face of the block 42 for pivotal attachment of the second cutting element 46 to the first cutting element 44. A generally V-shaped notch 62 is formed in the front face of the second cutting element 46. The notch 62 is ⅜" tall at the front face of the second cutting element 44 and extends ⅜" rearward along the length and across the entire width. As best seen in FIG. 3, the upper and lower faces of the notch 62 are slightly curved or convex.

The handle 60 operably connects a plurality of shears 14. The handle 60 is an elongate member such as a rod having a ½" diameter and a length of 21". The handle 60 passes through holes 58 in the distal portions of the second cutting elements 46 of the shears 14. The handle 60 extends substantially parallel with the front and rear faces of the lower member 16 over the length of the base 12 and is preferably long enough to allow a user to grasp both ends of the handle 60 outside of the location at which the handle 60 passes between the upper and lower limit members 26 and 24 at both ends of the base 12. The ends of the handle 60 may be knurled for easier gripping. It is of course understood that the handle 60 may be made from any number of different materials and may take any number of shapes, sizes, and configurations. For example the cross section of the handle 60 may be square or rectangular, and appropriately shaped holes may be provided in the second cutting element 46 for a keyed fit. The handle 60 may also be rigidly secured to one or more of the second cutting elements 46. Similarly, threaded members 64, such as set screws, or other means may be used to releasably secure the handle 60 to one or more of the second cutting elements 46. For ease of adjustment, it is preferred that the handle 60 be slidable through most if not all of the holes 58 of the second cutting elements 46.

Figure 4:
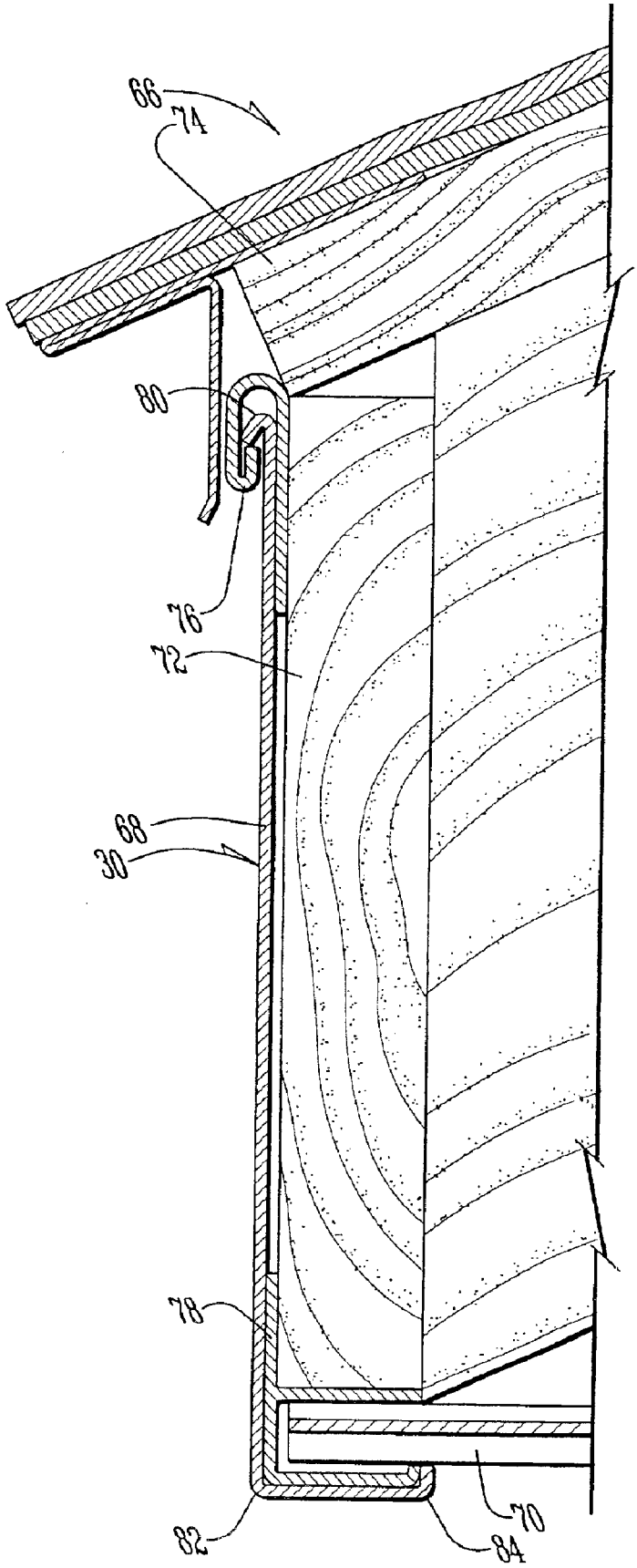
FIG. 4 is a side elevation view of a structure with a site-formed sheet affixed thereto.

In operation, sheet material 30, a brake or bending tool, and the cutting apparatus 10 of the present invention are provided to a work site having a structure 66 to which the sheet material 30 is to be affixed. The sheet material 30 is preferably coil stock, such as aluminum or vinyl coil stock, and is more preferably painted aluminum coil stock. Measurements are taken of the relevant portions of the structure 66 to determine desired locations for bends in coil stock to be affixed to the structure 66, such to cover fascia or soffit areas. For example, as best seen in FIG. 4, it may be desirable to site-form coil stock to form or cover eaves fascia 68 and to form or provide support for a soffit panel 70. A structure 66 may have eaves trim 72 affixed to or adjacent roof sheathing 74. Utility trim 76 may be affixed to the top of the eaves trim 72, and an F-channel 78 may be affixed to the bottom of the eaves trim 72. To site-form a piece of coil stock to serve as an eaves fascia 68, one might want to form one bend 80 in an upper portion of the coil stock so that the piece may be hung from the utility trim 76. Similarly, one might want to form two or more bends 82 and 84 in a lower portion of the coil stock so that the piece may be clipped over the F-channel 78.

After the relevant measurements are taken to determine the desired locations for bends in the coil stock, the shears 14 are positioned to slit the coil stock in the desired locations. To adjust the positioning of a shear 14, a user loosens the set screw 54, slides the shear 14 along elongate member 38 to the desired location, and tightens the set screw 54 to inhibit movement of the block 42 relative to the base 12. Markings 52 assist in determining the desired location of the shear 14. If a user wishes to adjust the length of the slits to be cut, the upper and lower limit members 26 and 24 may be adjusted to arrest upward and downward motion of the handle 60 at a desired location. Shears 14 may be added to or removed from the base 12 depending upon the number of bends desired. To add or remove shears 14, the fastener 40 securing the elongate member 38 to one of the end members 18 or 20 is removed, and the elongate member 38 is slid from the hole 22. One or more shears 14 may be added or removed, and the elongate member 38 secured back in place between the end members 18 and 20.

Figure 5:
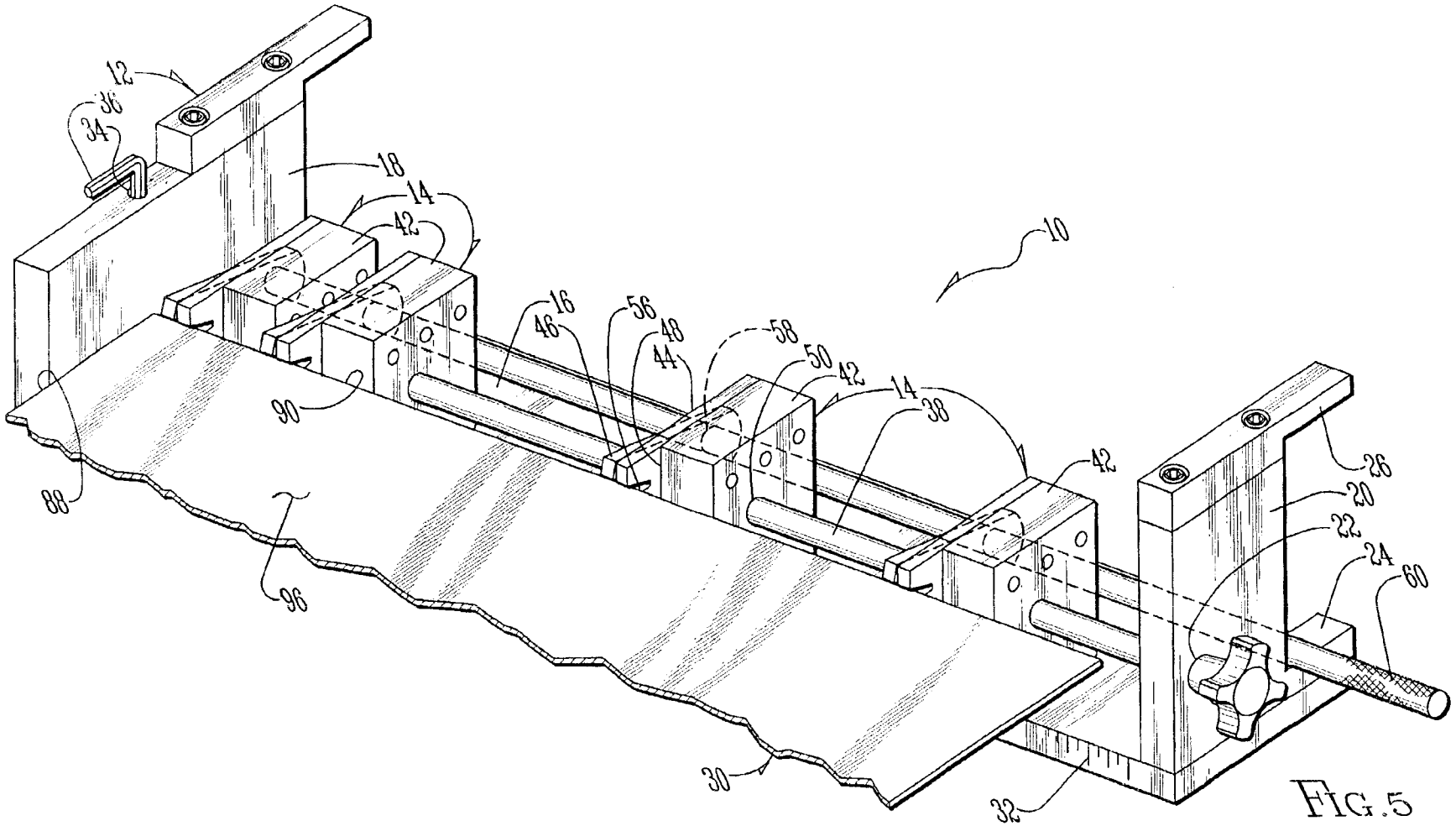
FIG. 5 is a front elevation view of a cutting apparatus with a sheet in place for cutting.
Figure 6:
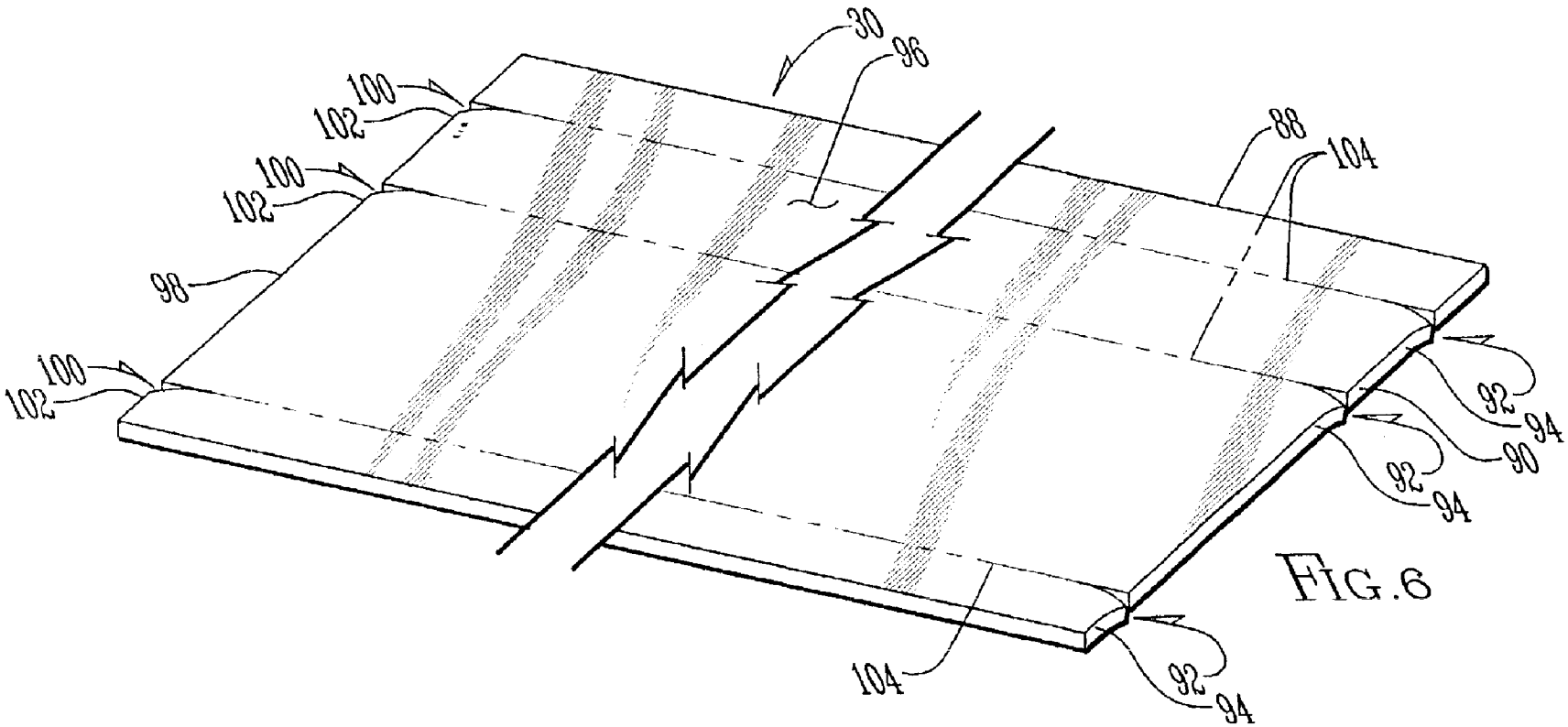
FIG. 6 is a partial elevation view of a sheet having slits cut according to the present invention.

Coil stock is unrolled and cut to provide a sheet of material 30 of the desired length and width. The cutting elements 44 and 46 are placed in a neutral position in which the upper faces of the cutting elements 44 and 46 are substantially parallel. As best seen in FIG. 5, the sheet 30 is positioned for cutting, with one side 88 of the sheet 30 abutting and flush with the stop portion 28 of the end member 20 and another side 90 of the sheet 30 in position within the notches 56 and 62 of the shears 14, abutting the back portions of the notches 56 and 62. With the sheet 30 in position, a user moves the handle 60 upward or downward until the handle 60 strikes the upper or lower limit members 26 or 24. The shears 14 simultaneously cut a first plurality of slits 92 (FIG. 6) in the side 90 of the sheet 30. As best seen in FIG. 6, the slits 92 are substantially uniform. For each, the slits 92 are substantially parallel with one another and have substantially the same length. Each slit 92 extends substantially perpendicular to side 90 and substantially parallel to the side 88. The front edge 94 of each slit 92 is displaced slightly downward from the rear edge of the slit 92.

The user removes the sheet 30 and flips it over so that the surface 96 of the sheet 30 that originally faced upward now faces downward. The user positions the sheet 30 for cutting with one side 88 abutting and flush with the stop portion 28. This is the opposite end of the same side 88 that abutted the stop portion 28 for the first cutting. Another side 98 of the sheet 30 is placed in position within the notches 56 and 62 of the shears 14. Side 98 is the side opposite and parallel to side 90. With the sheet 30 again in place, the user moves the handle 60 in the opposite direction until the handle 60 strikes the lower limit members 24 or upper limit members 26 to simultaneously cut a second plurality of slits 100 in side 98 of the sheet 30. For example, if the user rotated the handle 60 upward or counterclockwise to cut the first plurality of slits 92, the user would rotate the handle 60 downward or clockwise to cut the second plurality of slits 100, or vice versa. The slits 100 are substantially uniform with each other and with slits 92. For example, the slits 100 are substantially parallel with one another and have substantially the same length. Each slit 100 extends substantially perpendicular to side 98 and substantially parallel to the side 88. When surface 96 faces upward, the front edge 102 of each slit 100 is displaced slightly downward from the rear face of the slit 100. Each slit 92 aligns with a corresponding slit 100 so that a line 104 extending between corresponding slits 92 and 100 extends over the length of the sheet 30, substantially parallel to side 88 and substantially perpendicular to sides 90 and 98. Cutting the slits 92 and 100 so that the front edges 94 and 102 of corresponding pairs of slits 92 and 100 are displaced in the same direction or so that the rear faces of corresponding pairs of slits are displaced in the same direction provides for improved bending. For example, it reduces the risk of paint scratching, chipping or flaking during and after bending, and it reduces the risk of bends, buckles, or indentations in the bend. It is of course understood that the slits 92 and 100 need not be cut in opposite sides of the sheet 30. It is also understood that the slits 92 and 100 may be aligned in any number of different ways and may have any number of different lengths. It is also understood that the sheet 30 need not be flipped over between cuttings and that the handle 60 need not be moved in opposite directions to form the first and second plurality of slits 92 and 100. Similarly, it is understood that the handle 60 need not be displaceable or rotatable in both upward and downward directions.

After the first and second plurality of slits 92 and 100 are cut, the sheet 30 is removed from the cutting apparatus 10, and the brake or bending tool is used to form bends 80, 82, and 84 in the sheet 30 along lines 104 extending between corresponding slits 92 and 100 to site-form the sheet 30. After the bent sheet 30 is site-formed in this manner, it is affixed to the structure 66, such as by nailing or clipping it into place onto the structure 66 or onto utility trim 76 affixed to the structure 66. Although it is preferred that the bent sheet 30 be site-formed, it is understood that the cutting apparatus 10 may be used at a work site or remotely therefrom. Similarly, it is understood that the sheet material 30 may be bent at a work site or remotely therefrom.

Other modifications, changes, and substitutions are intended in the foregoing, and in some instances, some features of the invention will be employed without a corresponding use of other features. For example, the first cutting element 44 may be attached directly to the elongate member 38 or to the base 12. Similarly, the elongate member 38 need not be used to affix the shear 14 to the base 12. The base 12 may take any number of shapes, sizes, and configurations and may, for example, also serve as a base or part of a brake or bending tool. The shears 14 may take any number of shapes, sizes, and configurations. For example, the shears 14 need not have corresponding first and second cutting elements that are pivotally secured to one another. If used, the first and second cutting elements need not have corresponding notches 56 and 62 for cutting. It is also understood that the shears 14 may form slits 92 and 100 of any number of different shapes, sizes, and configurations. The cutting apparatus 10 may be formed from any of a wide variety of materials, and different parts of the cutting apparatus 10 may be formed from the same or different combinations of materials. Portions of the cutting apparatus 10 may for example be formed using metals, plastics, ceramics, woods, resins, or any number or combinations of materials. It is understood that all measurements and quantitative information are given by way of example only and are not intended to limit the scope of the invention. Accordingly, it is appropriate that the appended claims be construed broadly and in a manner consistent with the scope of the invention.

What is claimed is:

1. An apparatus comprising:

a base;

first shear comprising first and second cutting elements, said first cutting element being slidably secured to said base and said second cutting element being pivotally secured to said first cutting element; and a second shear comprising third and fourth cutting elements, said third cutting element being slidably secured to said base and said fourth cutting element being pivotally secured to said third cutting element.

2. The apparatus of claim 1, further comprising a handle operably connected to said second and fourth cutting elements.

3. The apparatus of claim 2, wherein said second cutting element has a hole passing through a distal portion thereof, said handle slidably passing through said hole in said second cutting element.

4. The apparatus of claim 3, wherein:

said second cutting element has a notch in a proximal end for receiving a sheet to be cut; and said first cutting element has a notch in a proximal end for receiving said sheet to be cut.

5. The apparatus of claim 1, wherein said base further comprises:

an upper limit member to arrest upward movement of said second and fourth cutting elements; and a lower limit member to arrest downward movement of said second and fourth cutting elements.

6. The apparatus of claim 1, wherein said base comprises:

a plate; and an elongate member secured to said plate said first and third cutting elements being slidably secured to said elongate member.

7. The apparatus of claim 6, wherein said base further comprises:

an upper limit member to arrest upward movement of said second and fourth cutting elements; and a lower limit member to arrest downward movement of said second and fourth cutting elements.

8. The apparatus of claim 6, further comprising:

a threaded member, said first cutting element having a first hole passing therethrough and having a second hole passing at least partially therethrough, said second hole communicating with said first hole; said elongate member slidably passing through said first hole in said first cutting element, and said threaded member being in threaded engagement with said second hole in said first cutting element so that said threaded member may be tightened against said elongate member to inhibit said first cutting element from sliding relative to said elongate member or so that said threaded member may be loosened to allow said first cutting element to slide relative to said elongate member.

* * * * *